US006193111B1

(12) United States Patent
Adams

(10) Patent No.: US 6,193,111 B1
(45) Date of Patent: Feb. 27, 2001

(54) POWERED CONDIMENT PUMPING SYSTEM

(76) Inventor: Rodney W. Adams, 38174 N. Harper Rd., Beach Park, IL (US) 60087

( * ) Notice: Subject to any disclaimer, the term of this patent is extended or adjusted under 35 U.S.C. 154(b) by 0 days.

(21) Appl. No.: 09/379,284

(22) Filed: Aug. 20, 1999

(51) Int. Cl.[7] ..... B67D 1/08

(52) U.S. Cl. ..... 222/148; 222/255; 222/263; 222/334; 222/389

(58) Field of Search ..... 222/148, 253, 222/255, 263, 334, 389

(56) References Cited

U.S. PATENT DOCUMENTS

| | | | | |
|---|---|---|---|---|
| 5,158,210 | * | 10/1992 | Du | 222/334 |
| 5,167,837 | * | 12/1992 | Snodgrass et al. | 222/255 |
| 5,366,117 | * | 11/1994 | Mesenbring et al. | 222/334 |
| 5,542,574 | * | 8/1996 | Stern | 222/389 |
| 5,996,846 | * | 12/1999 | Martindale | 222/334 |

* cited by examiner

*Primary Examiner*—Joseph A. Kaufman

(57) ABSTRACT

A powered condiment pumping system for pumping controlled portions from a dispenser receiving product from a substantial distance on the order of 30 feet or more. If includes a distantly disposed constant outlet pressure pump and a volumetric piston pump located adjacent the dispenser.

8 Claims, 2 Drawing Sheets

POWERED CONDIMENT PUMPING SYSTEM

BACKGROUND OF THE INVENTION

It is now common practice to dispense semi-liquid condiments like ketchup and mustard from sealed containers. A typical system uses a diaphragm-styled pump, that is driven by $CO_2$ gas to pull the condiment from the container and propel it through a tube to a dispenser. Dispensers are typically simple orifice and seal configurations where the seal is lifted off an orifice to allow the flow of product and returned by a spring when the actuator is released. Some systems have been developed which use various components to accomplish different goals such as dispensing in patterns and timing the dispense to provide for portion control.

A second type of system is used to dispense condiments in exact portions by the use of "volumetric" pumping. This type of pump has a cylinder that is filled with condiment and when activated a piston forces the condiment past a non-return valve and through a tube to the condiment dispenser. The stroke of the piston is limited to allow the precise adjustment of the amount of condiment dispensed. Depending on the maximum size of the portion required the portion can be regulated with an accuracy of (+/−) 1%.

Each of these systems have distinct advantages. The diaphragm pump can dispense condiments over longer distances than the piston pump. The diaphragm pump is a "demand" pump in that it will only pump when the outlet pressure falls, then it will simply pump until the pressure at the outlet is enough to keep it from pumping. The diaphragm pump cannot accurately dispense condiments by itself. Separate control mechanisms like solenoids and timers are required to control the portion size. These various options present problems since they operate independently of the desired final objective which is to provide correct condiment portioning. If the pressure applied to the pump varies the portion will vary.

It is known that the piston type pump is the best portioning device. It has accurate portion control and the dispensing speed can be adjusted to accommodate a particular application. Unfortunately it has a distinct disadvantage in that the distance from the pump to the dispenser is restricted to a few feet at most. Any distance greater than this will cause a reduction in dispensing speed due to the swelling and contraction of the line carrying the product to where it is being dispensed. The pump cannot be located directly behind the dispenser as the force required to pull the product from the container spaced a distance away would be prohibitive.

It can be appreciated that with either of the foregoing systems the problems are not so much related to getting the product from the pump to the dispenser as getting the product to the pump.

The most common type of container for powered condiment dispensing is the bag-in-box format. This is a flexible bag filled with product that has a fitting attached to the bag that can be connected to a product dispensing system. The bag is designed to contain the product and to collapse as the product is used. This type of bag has been used to contain other products for many years and is a well accepted arrangement in the food service industry. This bag system means the product contained therein is subject to atmospheric pressure of 14.7 PSI absolute. The inlet of both of the aforementioned systems is required to create a vacuum to pull the products from the bag to the inlet. As the pump pulls the product from the bag the tubing from the bag to the inlet of the pump causes friction that resists the flow of the product. This resistance limits the length of this tube to about 18". Any greater length will cause a reduction in pumping efficiency that can impact negatively on the life of the pump and the quality of the product. This is the reason that a piston type pump must be located near the bag and cannot be located near or at the dispenser.

While one might conclude that an easy solution would be to combine the two types of pumping styles together in one system this is not feasible since the piston style pumps being used are not capable of holding pressure as they use only non-return valves as controls. These valves will not accept inlet pressure without allowing product to flow during non-use periods. It thus becomes apparent that for a system to incorporate the benefits of both styles of pumping systems and provide accurate portion control over relatively long distances a new and novel system is required.

It is also essential that any new powered condiment dispensing system must reduce costs, both product and labor, and at the same time increase efficiency. At the very least any new equipment must replace other equipment at a savings of space, or cost or both.

SUMMARY OF THE INVENTION

In accordance with the present invention there is provided a new and novel powered condiment dispensing system that meets all the following criteria.

1. Precise portion control.
2. Permits the condiment to be stored at least 30 ft. from the dispensing area.
3. Will dispense product at sufficient speed to be used in preparation areas.
4. Will reduce costs of product and labor.
5. Easily maintains a high degree of sanitation.
6. Is easily cleaned by typical food service employees.

To this end there is provided a diaphragm pump that supplies product over a relatively long distance to a piston/volumetric pump located adjacent a dispensing unit. The piston/volumetric pump is designed to receive and dispense a predetermined volume of product when the dispenser is actuated. After the pump has been activated to dispense a predetermined portion the piston/volumetric pump is retracted and during this action a new volume of product is fed into the pump so it is ready to again dispense the requisite amount.

When it is desired to clean the system a separate diaphragm pump is activated to rapidly flush the system.

These and other objects, features and advantages of the present invention will become apparent from the following description.

DETAILED DESCRIPTION OF THE PREFERRED EMBODIMENT

Figure 1:
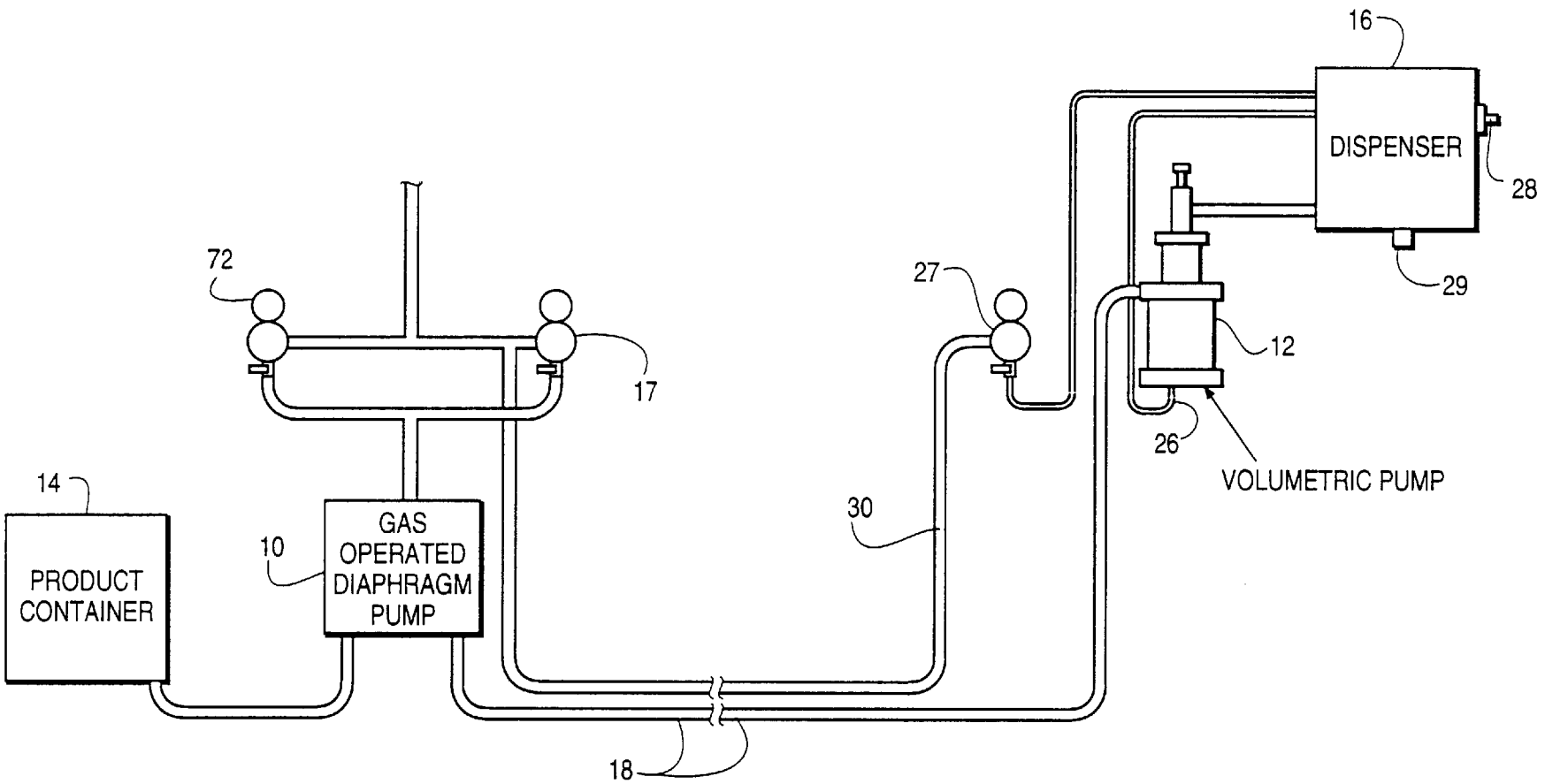
FIG. 1 is an overview of the novel condiment pumping system.

The present invention as shown in FIG. 1 combines a diaphragm pump 10 and a piston/volumetric pump 12 in a novel system to provide precise portion control from the product container such as a bag 14 to a dispenser 16 at a variable distance of up to 40 ft. The pump 10 is of the dual diaphragm variety that is powered by a compressed gas regulator 17 using a controlling gas such as air or carbon dioxide. This functions to pump the condiment product from a zero-pressure container such as the bag-in-box 14 and propel it through tube 18 of up to 40 ft. in length dependent of the product, The product then enters the piston/volumetric pump 12 that incorporates two chambers 20,22. The gas chamber 20 has a piston 24 that is moved by a compressed gas fed through line 26 that is controlled by the pressure regulator 27 -when activated by a dispenser control button 28 to dispense condiment through the dispenser outlet 29. There is also included a three way solenoid valve to activate the volumetric pump that is activated by a switch mounted in the dispenser. The pressure regulator 27 receives its source of gas under pressure through conduit 30. The outer edge of this piston 24 is in contact with the inner surface of the piston cylinder 31 so that application of gas under pressure will cause the piston 24 to move. The piston 24 is in direct contact with a compression spring 32 that will return the piston 24 to the start position when the stroke is completed.

Figure 2:
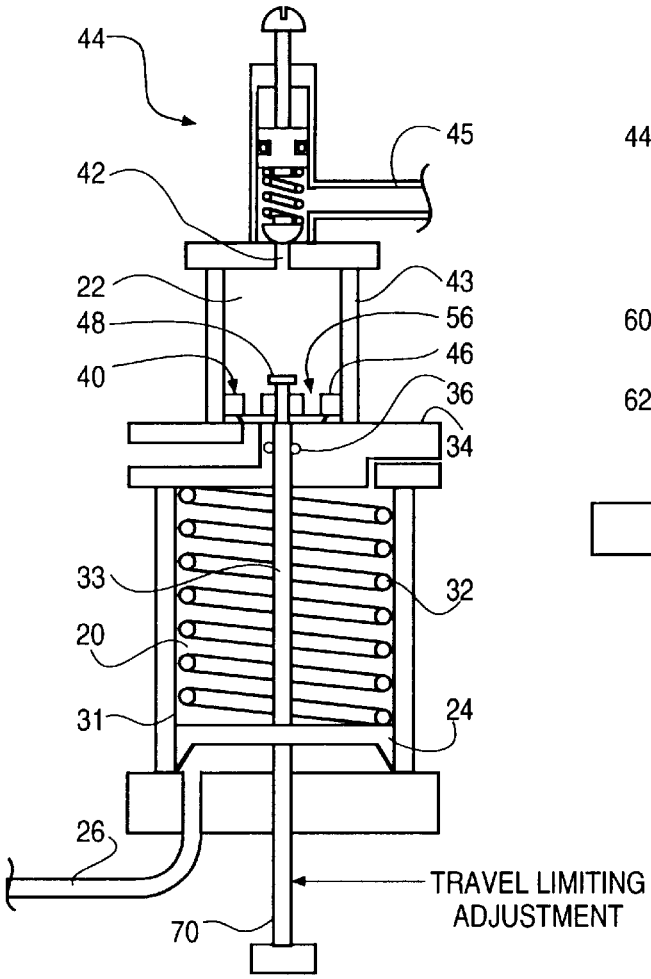
FIG. 2 is a sectional view of the details of the pump.
Figure 5:
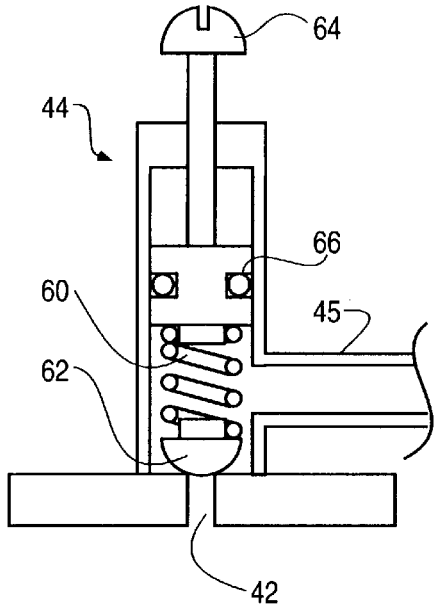
FIG. 5 illustrate the details of the outlet regulator.
Figure 3:
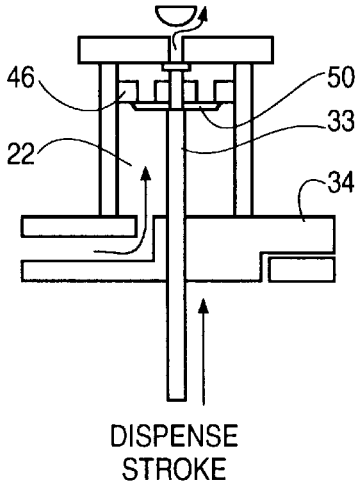
FIG. 3 is an enlarged view of the upper portion of the pump during the dispensing stroke.
Figure 4:
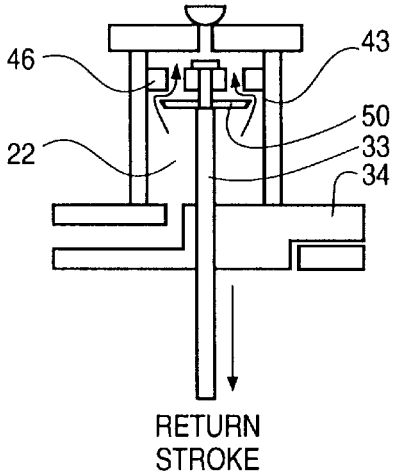
FIG. 4 is an enlarged view of the upper portion of the pump during the return stroke.

The gas piston 24 is connected via a piston rod 33 through the pump body 34 and seal 36 to the upper piston assembly 40. The upper piston assembly 40 includes a piston 46 that pushes product through the outlet 42 of the cylinder 43 and into the outlet regulator assembly 44 and out a dispensing tube 45. The upper piston 46 is designed to allow it to float in relation to the retainer 48 and the follower 50. This arrangement will allow the assembly to push product through the cylinder outlet 42 during the pumping cycle and allow product to go through the holes 56 in the piston during the return cycle to refill the cylinder 43. This is best understood by reference to FIGS. 3 and 4. FIG. 3 illustrates the dispensing stroke during which time the piston is being refilled through conduit 18 and FIG. 4 shows the return stroke when the follower is released from the piston to allow the chamber 22 to be refilled as shown in FIG. 2.

The outlet regulator assembly 44 is adjusted to keep the pressure from pushing the product through the volumetric portioning pump and out to the dispenser. The spring 60 maintains a force against the poppet 62 that is equal to the pressure of the product in the product cylinder outlet of the pump. The spring 60 can produce a variable force by use of the adjustment screw 64 and retainer 66 to accommodate varying lengths of tube and pressure from other parts of the system.

The portion size of the product dispensed can be adjusted by limiting the stroke of the piston's return stroke with the use of the travel limiting adjustment 70. The volumetric pump also includes a series of switches and stops in conjunction with electronic control means to apply various portion sizes from one pump.

OPERATION

When activated this system has the advantage of using a diaphragm type pump to propel product from a location remote from the dispenser. It can also precisely portion control the product at the dispenser. The product dispenser can be made to any style or configuration to match the needs of the end user.

When this system is first activated the product will be suctioned from the zero-pressure container and propelled through the initial tube by a dual diaphragm pump to deliver the product to the dispenser area. The dual diaphragm pump will activate and repressurize the line to the set pressure. The product will enter the volumetric pump and flow into the upper cylinder. There will not be enough pressure to pump the product past the poppet of the outlet regulator so the product will stop at this point. When the volumetric pump is activated there will be an increase in pressure in the upper cylinder. The product will then be able to overcome the force of the spring in the outlet regulator and exit the pump. The product will then enter the dispenser. Part of the dispenser is a three-way gas valve to allow compressed gas to activate the volumetric pump. This valve will hold base pressure from the gas regulator until activated. When activated the valve will allow compressed gas to pass the valve and enter the gas cylinder of the volumetric pump and cause the piston and piston rod to move, thereby moving the upper piston and propelling product to the dispenser. The gas piston, being larger in diameter than the upper piston will cause the pressure in the upper piston to be greater than the gas pressure. The volumetric pump gas regulator will regulate the speed of dispense as it will cause the piston to move the product faster or slower dependent on the pressure. This regulation will occur regardless of the pressure applied to the dual diaphragm pump. The act of the volumetric pump pushing product out the top the of pump also causes the upper piston to draw product into the upper cylinder in preparation of the next cycles of dispense, thus the power stroke of the pump will also draw product into the pump.

CLEANING

The system will incorporate a second, or cleaning regulator 72. This device will be set to a higher pressure than the primary gas regulator that powers the diaphragm pump. When the system needs cleaning the cleaning process will be expedited by having a higher pressure available to propel the cleaning solution through the system with enough force to overcome the spring in the outlet regulator of the volumetric pump.

Also, if desired two or more volumetric pumps can be installed in one system to accomplish multiple portion sizes.

It is intended to cover by the appended claims all modifications and embodiments that fall within the true spirit and scope of the invention.

What is claimed:

1. A powered condiment pumping system for pumping product from a container to an outlet dispenser, comprising a constant outlet pressure pumping means adjacent said container and a volumetric piston pump disposed adjacent said dispenser at a substantial distance from said container, and valve and regulator means operating said pumping means and piston pump to provide portion controlled amounts through said dispenser.

2. A powered condiment pumping system as set forth in claim 1 wherein said constant outlet pressure means comprises a gas operated diaphragm pump.

3. A condiment system according to claim 2 wherein said volumetric pump comprises two aligned chambers with a first chamber containing a spring biased piston adapted to be exposed to gas under pressure and a second chamber including a piston connected to said first piston and an inlet exposed to product under pressure, and the outlet of said product filled chamber being controlled by an outlet regulator whereby when said valve and regulator means are actuated to move said spring biased piston against the action of said spring the product in said second chamber will overcome said outlet regulator and dispense a preselected portion of said condiment.

4. A condiment system according to claim 3 including means for adjusting the force applied to said outlet regulator.

5. A condiment system according to claim 3 in which the piston in the second chamber defines openings therein, which piston can move between a follower and retainer whereby when the spring biased piston is exposed to gas under pressure the openings in the piston in said second chamber will be closed by said follower to move product through the outlet regulator and when the gas pressure is released the follower and piston will be sequentially retracted to permit the second chamber to be refilled with product.

6. A condiment system as set forth in claim 5 in which the product to be dispensed is maintained under pressure is said second chamber by the operation of the gas operated diaphragm pump.

7. A condiment system in accordance with claim 1 including a gas pressure regulator to apply higher pressure to the constant outlet pressure pumping means when said means is a gas operated diaphragm pump for the purpose of cleaning the system.

8. A condiment dispensing system according to claim 1 wherein a three way solenoid valve is used to activate the volumetric pump and means in said dispenser for activating said valve.

* * * * *